US007108202B1

(12) United States Patent
Chang

(10) Patent No.: US 7,108,202 B1
(45) Date of Patent: Sep. 19, 2006

(54) STRUCTURE OF A SWIRL GENERATOR FOR LIQUID

(76) Inventor: Hong-Jun Chang, No.12, Alley 8, Lane 211, Hueiming St., Yuanlin Township, Changhua County (TW)

( * ) Notice: Subject to any disclaimer, the term of this patent is extended or adjusted under 35 U.S.C. 154(b) by 0 days.

(21) Appl. No.: 11/088,521

(22) Filed: Mar. 25, 2005

(51) Int. Cl.
*B05B 1/34* (2006.01)

(52) U.S. Cl. ..... 239/380; 239/263.1; 239/264; 4/541.1; 4/541.6

(58) Field of Classification Search ..... 239/225.1, 239/251, 261, 263.1, 264, 380, 381, 382, 239/383; 4/541.1, 541.3, 541.4, 541.5, 541.6
See application file for complete search history.

(56) References Cited

U.S. PATENT DOCUMENTS 5,056,168 A * 10/1991 Mersmann ..... 4/541.6
5,335,376 A * 8/1994 Kaldewei ..... 4/541.6
5,386,598 A * 2/1995 Mersmann ..... 4/541.6
6,065,161 A * 5/2000 Mateina et al. ..... 4/541.6
6,991,182 B1 * 1/2006 Chen ..... 239/380

* cited by examiner

*Primary Examiner*—Steven J. Ganey
(74) *Attorney, Agent, or Firm*—Egbert Law Offices

(57) ABSTRACT

The structure of swirl generator for liquid includes a motor with a head affixed to a swirl generator. The bearing seat of the swirl generator forms a fixation section, allowing the swirl extension to be affixed to the inside of the bearing seat easier and quicker, and installing the water guide cover at the opening of the bearing seat. Therefore, the swirl generator structure has advantages of easy assembly and decomposition for repair.

5 Claims, 6 Drawing Sheets

STRUCTURE OF A SWIRL GENERATOR FOR LIQUID

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a swirl generator for liquid.

BACKGROUND OF THE INVENTION

The swirl generator for liquid refers to a structure that is mainly used on environments or objects such as massage tub, foot spa, hot spring pool or others that require spurting turbulent flow of water to generate swirl. It mainly comprises a drive motor and swirl nozzle, in which the drive motor drives the rotor inside the swirl nozzle to draw in water, adds pressure, then spurts the water column in strong force from the nozzle or keeps the water from staying still so as to improve the quality and increase the oxygen content of the water. Since the conventional swirl generator comprises numerous parts, and the assembly is not easy, it has problems of difficulty in assembly and decomposition, thus, causes inconvenience in repair. If the repairmen press the parts into the unit, the product quality may be significantly reduced and the time for assembly may increase. Therefore, the convention swirl generator does not meet the cost benefit of the modern industry. Thus, to overcome the aforementioned problems of the prior art, it would be an advancement if the art to provide an improved structure of swirl generator for liquid that can significantly improve the efficacy.

To this end, the inventor has provided the present invention of practicability after deliberate design and evaluation based on years of experience in the production, development and design of related products.

BRIEF SUMMARY OF THE INVENTION

The operating principles of the present invention are as follows:

The rotating shaft 11 of the motor 1 drives the rotation of the rotor 23 to draw in the fluid (water) from the outside into the bearing seat 21 through the mesh 251 of the water guide cover 25, then force the water through the annular cone 222 of the diversion plate 22; it is to push the water by the strong turbulence of the whirly blade 231 inside the rotor 23 to the inside of the diversion case 24, then guide the water by the whirly partitioning protruding rib 243 of the diversion case 24 to form swirl, and finally, spurt from the spurting outlet 252 of the middle of the water guide cover 25.

The effects of the present invention are as follows:

The assembly of the swirl generator 2 uses the fixation section 215 formed inside the bearing seat 21 to provide assembly with the connecting section 221, 246 of the diversion plate 22 and diversion case 24. Therefore, the components inside the bearing seat 21, namely, diversion plate 22, rotor 23, and diversion case 24, are affixed beforehand to avoid loosening or coming off, so that the outer end of the bearing seat 21 can wedge the water guide cover 25 more easily. During the assembly process, even if the bearing seat 21 is not placed in the exact angle, the components will not be displaced or detached. The present invention allows the assembly of the swirl generator 2 and motor 1 to become easier and quicker. The present invention provides advantages of improvement in the quality ratio, convenient assembly and decomposition, reduction in the assembly time, and cost effectiveness.

The outside of the bearing seat 21 forms the outer thread of screw 216, allowing the fixed cover 30 to screw on for fixation and quick assembly or decomposition. The present invention improves the problem found in the conventional structure that separate affixation by using screws is required for each part.

The structure of the swirl extension 3, along with the fixation section 215 inside the bearing seat 21, can make the swirl extension 3 easier to assemble and decompose. The present invention provides a structure that is easier to clean and prevent the filth from accumulating inside the bearing seat 21, thus, allows the swirl extension 3 to operate more smoothly and prolongs the product life.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
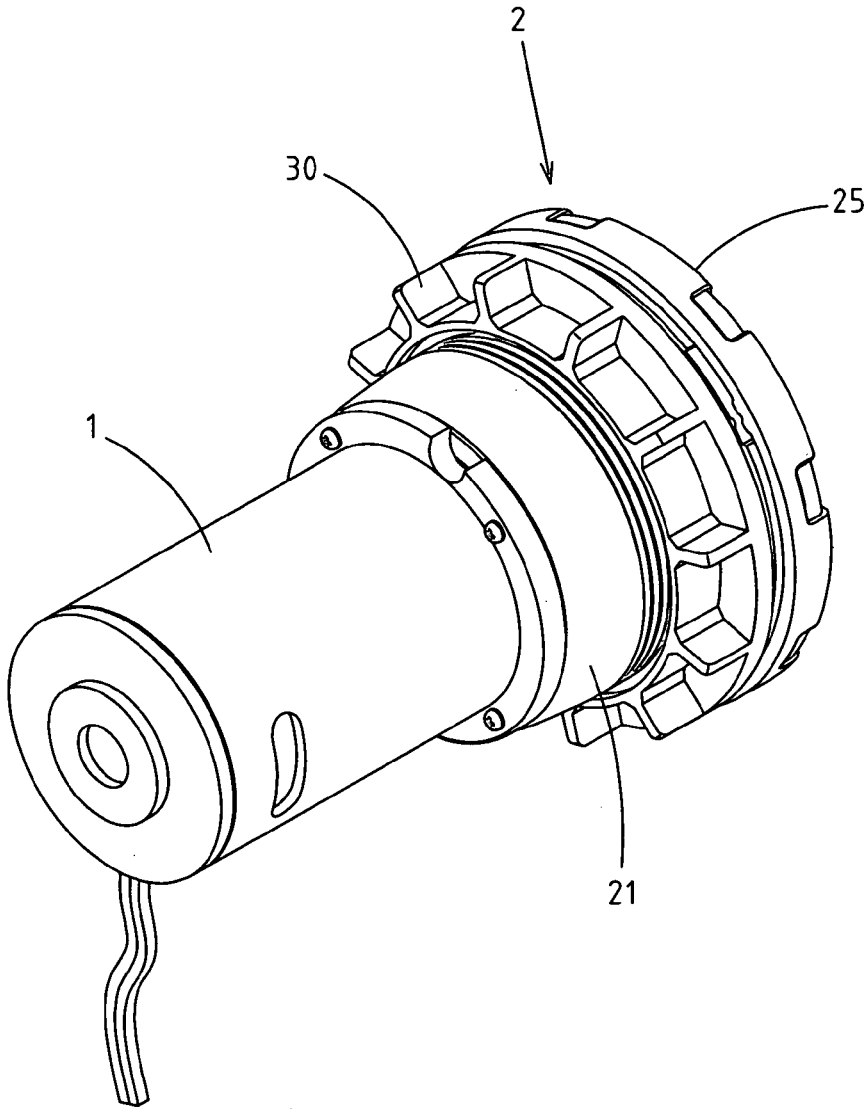
FIG. 1 shows an assembled perspective view of the present invention.
Figure 2:
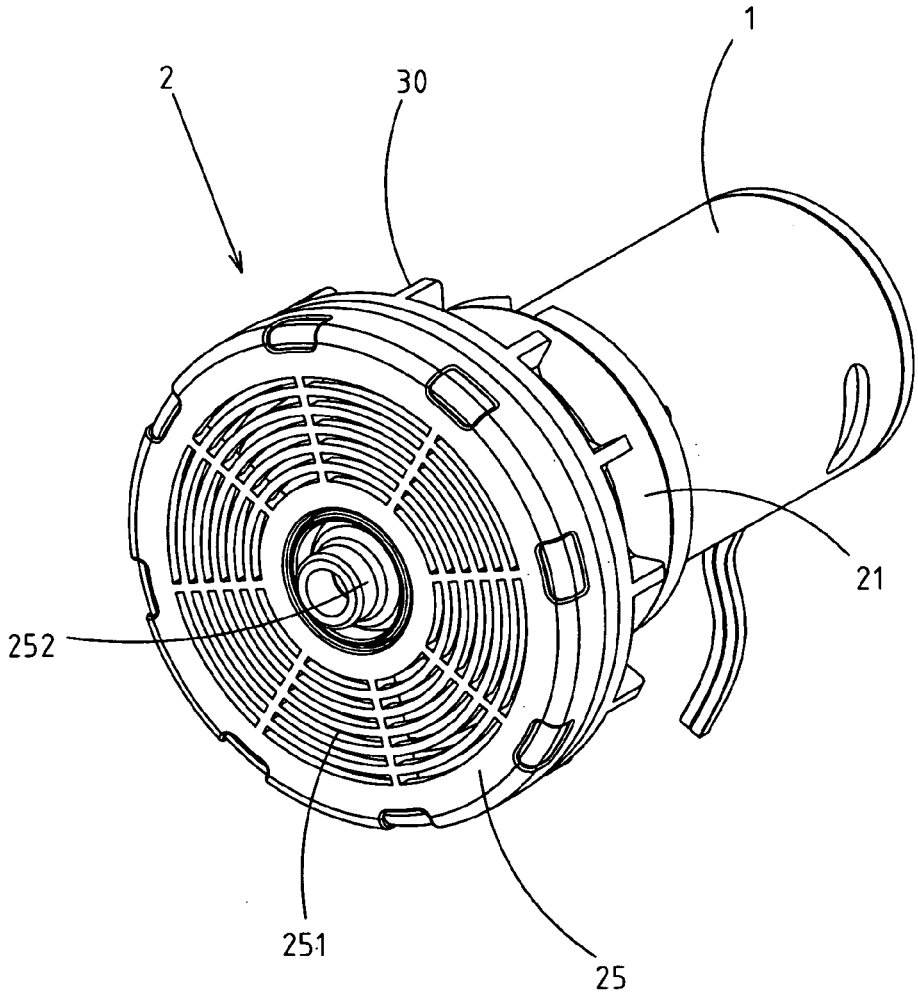
FIG. 2 shows an assembled perspective view of the present invention from another angle.

The features and the advantages of the present invention will be more readily understood upon a thoughtful deliberation of the following detailed description of a preferred embodiment of the present invention with reference to the accompanying drawings.

As shown in FIGS. 1–4, an improved structure of swirl generator for liquid comprises: a motor 1, which head is affixed to a swirl generator 2; the said swirl generator 2 comprises a bearing seat 21 which has a swirl extension 3 inside; the said swirl extension 3 comprises a diversion plate 22, a rotor 23, a diversion case 24 inside the bearing seat 21 in sequence, and which outer opening 211 of the bearing seat 21 is covered by a water guide cover 25; the said bearing seat 21 has a through hole 212 in the center, providing a space for the rotating shaft 11 of the motor 1 to go through to inside the bearing seat 21, and a rotating shaft 11 is inserted into the rotor 23; the inside and circumference of the said rotor 23 form a whirly blade 231, and the inner end of the diversion case 24 corresponds with the said rotor 23 to form an opening fillister 241, which inner wall is near the outer opening 242 of the diversion case 24 to form a whirly partitioning protruding rib 243; the said protruding ribs 243 together form a outward convergent taper 244, which has a central column 245 inside, which serves as the central pivot for the outer surface of the rotor 23, and allows the rotor 23 to fit inside the diversion case 24 to drive the rotation; the surface of the said water guide cover 25 is in form of mesh 251 and has a spurting outlet 252 in the center, and it connects to the ring 253 at the middle of inside the water guide cover 25 so that the spurting outlet 252 is able to rotate and adjust the spurting angle; the said ring 253 is slipped onto the outer outlet 242 of the diversion case 24 for positioning and conduction; the inner loop wall 254 on the outside of the said water guide cover 25 has a few protruding wedges 255, and the outer wall 213 of the bearing seat 21 outer opening 211 form several L-shape grooves 214 so that the water guide cover 25 covers the bearing seat 21 outer opening 211, and use the protruding wedge 255 and L-shape groove 214 to position the rotating wedge. Whereas, the bearing seat 21 inner wall close to the bottom forms a fixation section 215, and the circumference of the diversion plate 22 and diversion case 24 corresponds to the fixation section 215 to form corresponding connecting section 221 246, so that the swirl extension 3 can be assembled to the bearing seat 21 quickly and easily.

Figure 3:
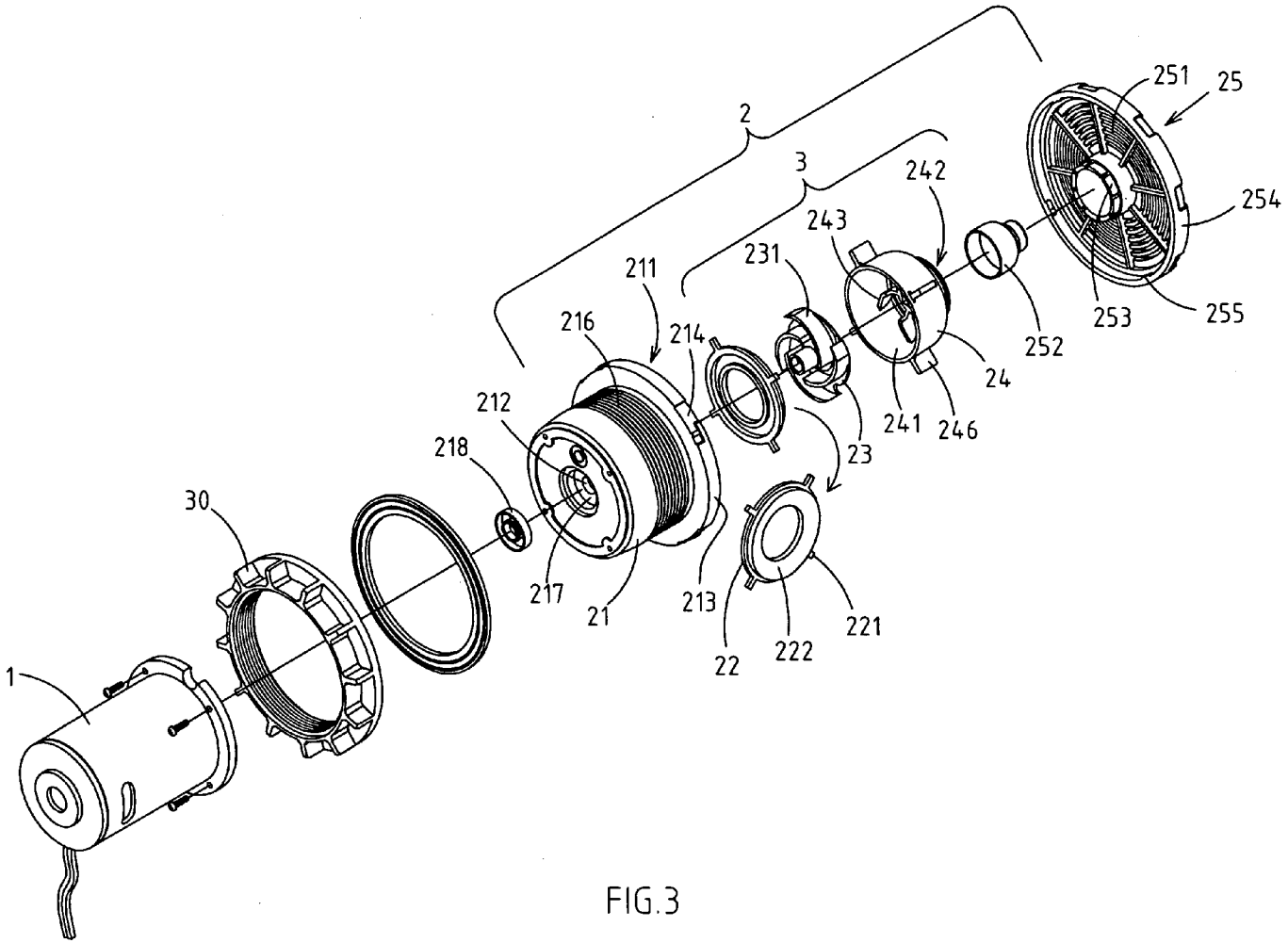
FIG. 3 shows an exploded perspective view of the present invention.
Figure 4:
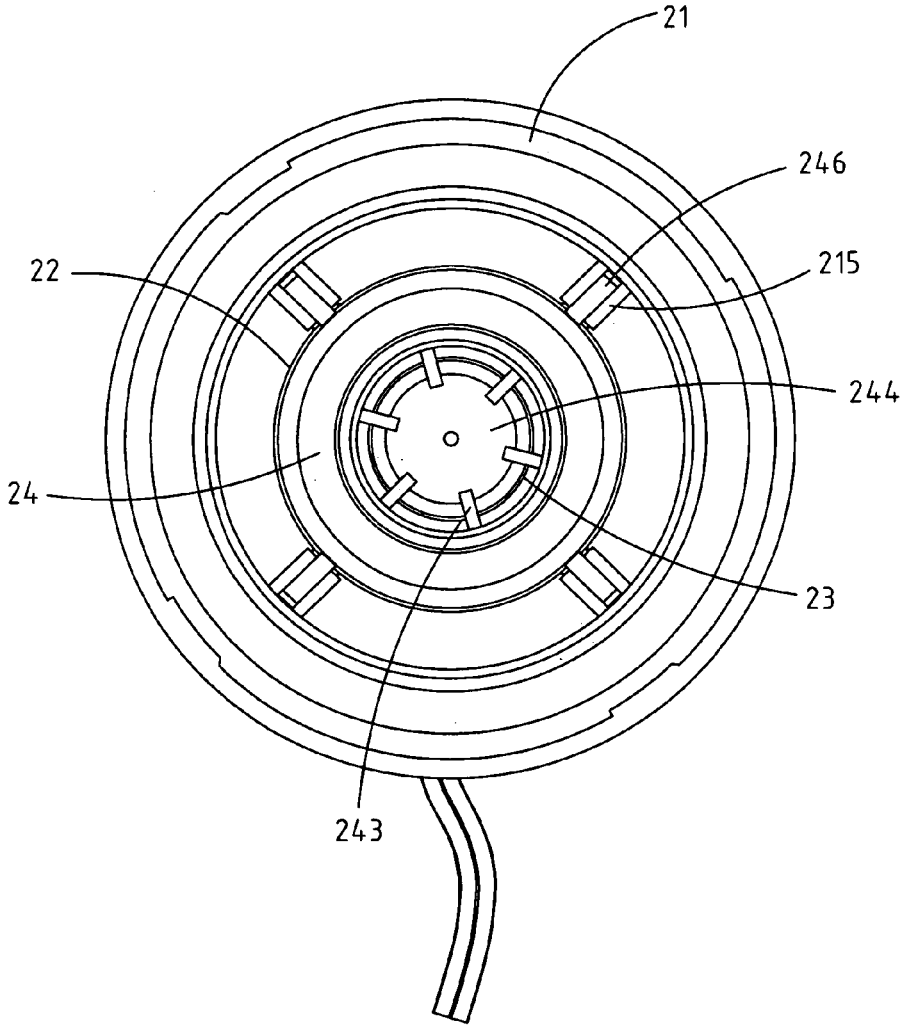
FIG. 4 shows an assembled elevation view of the swirl generation without the cover of the water guide cover.
Figure 5:
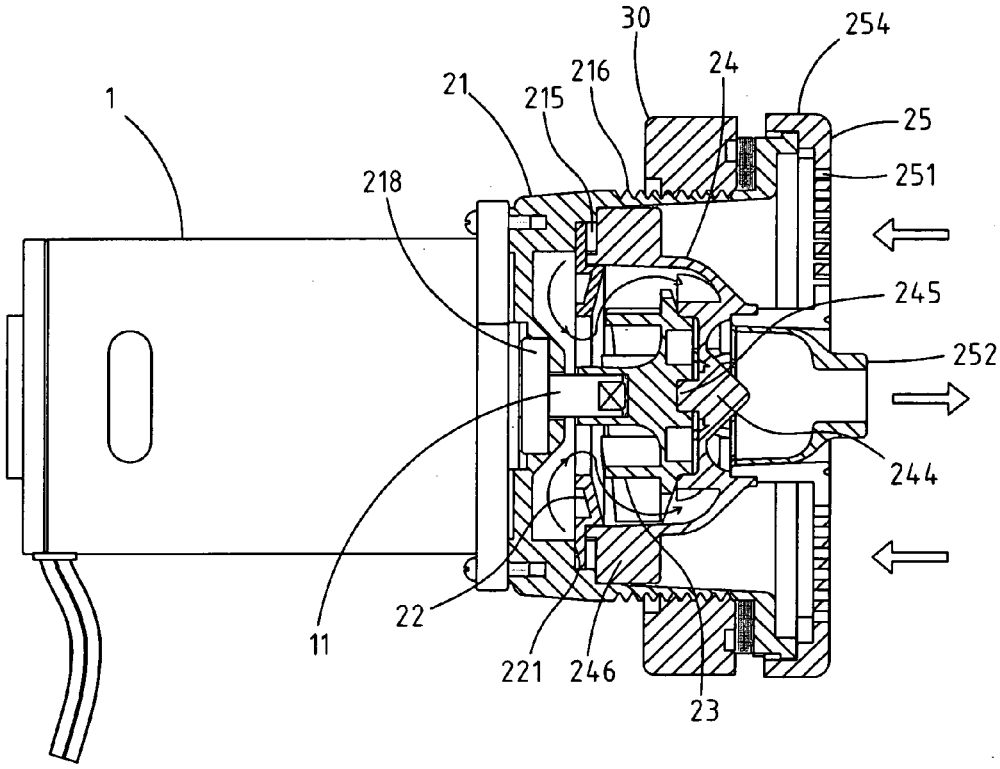
FIG. 5 shows an assembled sectional view of the present invention.

As shown in FIGS. 3–5, an improved structure of swirl generator for liquid, in which, the fixation section 215 formed by the bearing seat 21 inner wall can be several grooves.

As shown in FIGS. 3–5, an improved structure of swirl generator for liquid, in which, the circumference of the connecting section 221, 246 of the diversion plate 22 and diversion case 24 can be several protruding panels.

As shown in FIGS. 3–5, an improved structure of swirl generator for liquid, in which, the diversion plate 22 is in ring shape, which surface faces the inside of the rotor 23 to form convergent annular cone 222.

As shown in FIGS. 3–5, an improved structure of swirl generator for liquid, in which, the circumference of the bearing seat 21 forms the outer thread of screw 216, to screw on the fixed cover 30 for the swirl generator 2 to affix the external parts.

As shown in FIGS. 3–5, an improved structure of swirl generator for liquid, in which, the middle bottom of the bearing seat 21 forms a fillister 217 to hold a stopper 218 for the rotating shaft 11 of the motor 1 to go through so that the bearing seat 21 and motor 1 can be tightly connected to prevent leakage.

Figure 6:
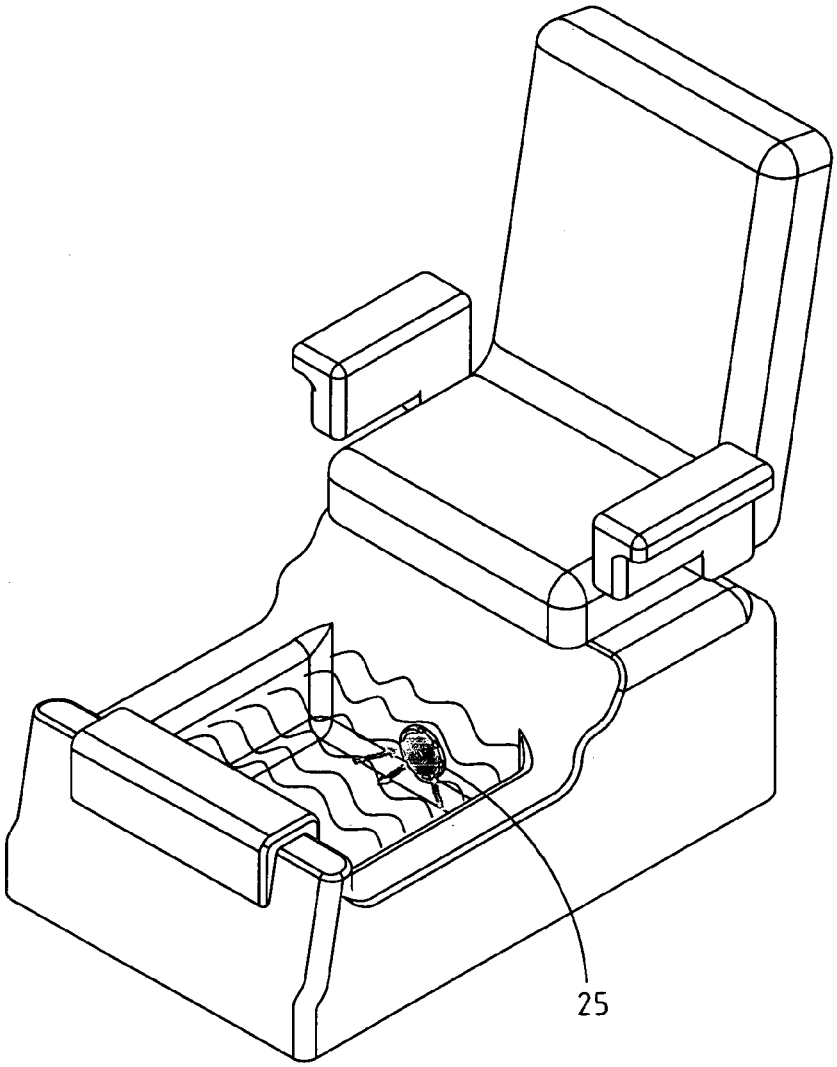
FIG. 6 shows a perspective view of an embodiment of the present invention.

FIG. 6 shows the embodiment of an improved structure of swirl generator for liquid in a foot spa.

I claim:

1. A structure of a swirl generator for liquid comprises:

a motor with a head affixed to a swirl generator, said swirl generator comprising a bearing seat having a swirl extension therein, said swirl extension comprising a diversion plate, a rotor, a diversion case inside said bearing seat in sequence, an outer opening of the bearing seat being covered by mesh and a water guide cover, a rotating shaft of the motor passing through an inside of the bearing seat to connect to the rotor wherein a bearing seat inner wall close to the bottom forms a fixation section, a circumference of the diversion plate and diversion case corresponding to the fixation section to form corresponding connecting section, said swirl extension being assembled to the bearing seat.

2. The structure of a swirl generator for liquid defined in claim 1, wherein the fixation section formed by the bearing seat inner wall is comprised of several grooves.

3. The structure of a swirl generator for liquid defined in claim 1, wherein the circumference of the connecting section of the diversion plate and diversion case is comprised of several protruding panels.

4. The structure of a swirl generator for liquid defined in claim 1, wherein the diversion plate is in ring shape, a surface thereof facing an inside of the rotor to form convergent annular cone.

5. The structure of a swirl generator for liquid defined in claim 1, wherein the circumference of the bearing seat forms the outer thread of screw, being screwable on the fixed cover for the swirl generator to affix external parts.

* * * * *